United States Patent [19]

Kanoto

[11] Patent Number: 5,047,803

[45] Date of Patent: Sep. 10, 1991

[54] IMAGE FORMING APPARATUS WITH DETACHABLY MOUNTABLE PROCESS CARTRIDGE

[75] Inventor: Masanobu Kanoto, Tokyo, Japan

[73] Assignee: Canon Kabushiki Kaisha, Tokyo, Japan

[21] Appl. No.: 313,539

[22] Filed: Feb. 22, 1989

[30] Foreign Application Priority Data

Mar. 2, 1988 [JP] Japan ..... 63-047637
Mar. 2, 1988 [JP] Japan ..... 63-047638

[51] Int. Cl.[5] ..... G03G 15/00
[52] U.S. Cl. ..... 355/211; 355/200
[58] Field of Search ..... 355/211, 296, 260, 200, 355/245, 210

[56] References Cited

U.S. PATENT DOCUMENTS 4,530,588 7/1985 Kimura et al. ..... 355/211
4,598,992 7/1986 Landa et al. ..... 355/211
4,739,367 4/1988 Watanabe et al. ..... 355/260 X
4,760,424 7/1988 Ohba et al. ..... 355/296 X

FOREIGN PATENT DOCUMENTS 0255713 2/1988 European Pat. Off. .
0285139 10/1988 European Pat. Off. .
0137151 11/1978 Japan ..... 355/211
0279869 12/1986 Japan ..... 355/200
0282876 12/1986 Japan ..... 355/296
0209546 9/1987 Japan ..... 355/211
11959 1/1988 Japan .

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image forming apparatus includes a supporting member for detachably supporting a process cartridge which contains a movable image bearing member and at least one process device for generating an image on the image bearing member. The apparatus also includes an openable and closable member, a member for applying to the process cartridge a force for urging the process cartridge in a direction of dismounting the process cartridge, in response to opening of the openable and closable member, and a member for applying to the process cartridge a force for urging the process cartridge in a direction for mounting the process cartridge to the supporting member, in response to closing of the openable and closable member.

25 Claims, 7 Drawing Sheets

IMAGE FORMING APPARATUS WITH DETACHABLY MOUNTABLE PROCESS CARTRIDGE

FIELD OF THE INVENTION AND RELATED ART

The present invention relates to an image forming apparatus such as an electrophotographic copying apparatus, an electrophotographic printer using a laser beam, a LED array, a liquid crystal shutter array or the like and other electrostatic recording apparatus, more particularly to an image forming apparatus of such a type wherein a process cartridge containing at least a movable photosensitive member and at least one process means for forming an image on said image bearing member is detachably mountable.

In the field of an image forming apparatus which is small in size and which is free from maintenance, a process cartridge type becomes widely used wherein an image bearing member (photosensitive member) for bearing an image and at least one process means (for example, charger, developing device and cleaner and other elements) for forming an image thereon are constituted as a unit, which is detachably mountable into a main assembly of the apparatus, taking an electrophotographic apparatus as an example of the image forming apparatus.

In the process cartridge type image forming apparatus, various means and elements in the process cartridge are driven from the main assembly of the image forming apparatus. More particularly, when the process cartridge is mounted in place in the main assembly, a gear of the cartridge for driving the image bearing member in the cartridge is meshed with a driving gear of the main assembly to receive driving force. Further, the process means in the cartridge is mechanically driven by the force imparted to the image bearing member. In the conventional apparatus, when the process cartridge is dismounted from the main assembly of the image forming apparatus for interchange or exchange of the process cartridge, the meshing engagement between the gear in the cartridge and the gear in the main assembly is completely released, and then, the process cartridge is taken out of the main assembly. By doing so, no particular load is applied to the process cartridge, and therefore, the cartridge can be relatively easily dismounted.

However, if an attempt is made to take out the process cartridge from the main assembly under the condition that the gear in the cartridge (driven gear) and the gear in the main assembly (driving gear) are in meshing engagement, it is difficult to take the cartridge out of the apparatus if the driving gear is locked. This is remarkable when the direction of the mounting or dismounting of the cartridge relative to the main assembly is not parallel with the direction of the length of the image bearing member.

SUMMARY OF THE INVENTION

Accordingly, it is a principal object of the present invention to provide an image forming apparatus wherein the process cartridge can be easily dismounted from the main assembly of the image forming apparatus.

It is another object of the present invention to provide an image forming apparatus wherein the process cartridge can be stably placed in the predetermined position in the main assembly of the image forming apparatus, when the image forming operation is performed with the process cartridge mounted in the main assembly of the image forming apparatus.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
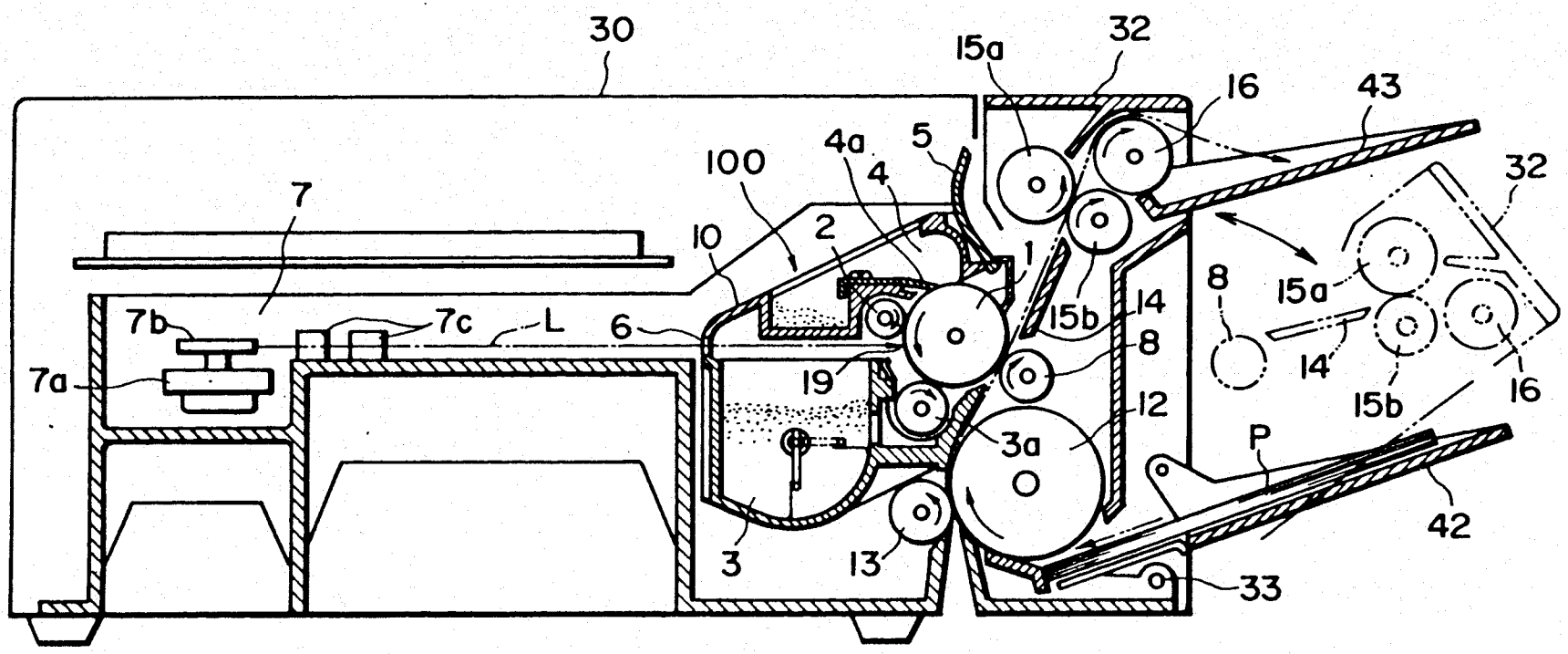
FIG. 1 is a sectional view of a general arrangement of a laser beam printer, as an exemplary image forming apparatus, according to an embodiment of the present invention.

Referring to FIG. 1, there is shown a laser beam printer as an exemplary image forming apparatus, according to an embodiment of the present invention.

The printer is provided with an outer casing 30. The front side of the apparatus is shown in FIG. 1 as the righthand side. The outer casing 30 includes a front door 32 which is pivotable about an axis 33 disposed at a bottom portion, so that the front door 32 may be opened as shown by chain lines or may be closed as shown by solid lines in this Figure. When the printer is serviced and/or when a process cartridge 100 is mounted into or dismounted from the main assembly of the printer, the front door 32 is opened to allow wide access to the inside thereof. The process cartridge 100 in this embodiment includes a cartridge housing 10 and contains therein a photosensitive drum 1, a charging roller 2, a developing device 3 and a cleaning device 4 as image forming process means. It is detachably mountable into the printer casing 30 at a predetermined accommodating position when the front door 32 is opened as shown by chain lines. A protection cover 5 is openably and closably mounted to the housing 10 to protect the photosensitive drum.

The present invention is applicable where the charging roller 2, the developing device 3 or the cleaning device 4 is not contained in the cartridge 100 or where another process means is contained in the cartridge.

The outer casing 30 contains a laser beam scanner 7 disposed at a rear side therein, and the laser beam scanner 7 includes a semiconductor laser source, a scanner motor *7a*, a rotatable scanning mirror *7b* such as a polygonal mirror, a lens system *7c* and others. The laser beam L from the scanner 7 travels substantially horizontally through an exposure window 6 of the cartridge housing 10 of the cartridge mounted therein. The laser beam L further travels between the cleaning device 4 and the developing device 3 disposed at upper and lower sides, respectively. It reaches the left side of the photosensitive drum 1 at the exposure station 19. By the rotation of the mirror 7*b* the photosensitive drum 1 surface is scanned in the direction of its generating line and is exposed to the laser beam.

The apparatus further comprises a multi-feeding tray 42 which extends out of the front door 32 and which is inclined upwardly toward outside. A plurality of sheet materials P can be set therein.

The apparatus further includes a sheet feeding roller 12 disposed at a lower portion inside the front door 32, a conveying roller 13 in rolling contact with a left side of the feeding roller 12, an image transfer roller 8 disposed above the feeding roller 12 inside the front door 32, a couple of image fixing rollers 15*a* and 15*b* disposed at an upper portion inside the front door 32, a sheet guiding plate 14 disposed between the transfer roller 8 and the fixing roller couple 15*a* and 15*b*, a sheet material discharging roller 16 disposed at a sheet outlet side of the fixing roller couple 15*a* and 15*b* and a tray 43 for receiving the sheet materials discharged from the apparatus.

When an image formation start signal is inputted into the control system of the printer, the photosensitive drum 1 is rotated at a predetermined peripheral speed in the direction as indicated by an arrow. During the rotation, the periphery thereof is uniformly charged to a predetermined polarity, positive or negative by the charging roller 2. A predetermined voltage is applied to the charging roller 2. It is preferable that the charging roller 2 is positively rotated in the same peripheral direction and at the same peripheral speed as the photosensitive drum 1 or that the charging roller 2 follows the photosensitive drum 1 to rotate. The charging means is not limited to the charging roller but may be of any known type such as a corona charger.

Then, the surface of the photosensitive drum 1 having been uniformly charged is exposed, at the exposure station 19, to the laser beam L bearing time series picture element signals representing image information to be printed produced by the laser beam scanner 7, so that the photosensitive drum surface is subjected to the main scan operation by the laser beam L in the direction of the generating line of the drum, by which an electrostatic latent image of the image information is formed on the photosensitive drum 1 surface.

The electrostatic latent image thus formed on the photosensitive drum 1 is sequentially developed with a developer carried on a developing sleeve (or roller) 3*a* of the developing device 3 into a toner image. In this embodiment, the latent image is formed by projecting a laser beam spot L at the image area of the surface of the photosensitive drum 1 which has been uniformly charged, so that the charge is removed from the photosensitive drum 1. Therefore, the developing operation is a reversal development by which the developer having the same polarity has the polarity of the charge remaining on the photosensitive drum 1, so that the toner is deposited at the portion exposed to the laser beam.

On the other hand, the topmost sheet of the sheets (transfer material) P accommodated in the multi-feeding tray 42 is introduced into the printer by the feeding roller 12 which is rotating in the direction indicated by an arrow. The sheet is conveyed into the nip formed between the feeding roller 12 and the conveying roller 13 and is advanced at a constant speed substantially equal to the peripheral speed of the photosensitive drum 1 into the contact area between the photosensitive drum 1 and the transfer roller 8 constituting a transfer station. The sheet P fed into the transfer station receives the toner image from the surface of the photosensitive drum 1 during its passage between the photosensitive drum 1 and the transfer roller 8 by the function of the voltage of the polarity opposite to that of the toner applied to the transfer roller 8 and the pressure between the transfer roller 8 and the photosensitive drum 1. The application of the voltage to the transfer roller 8 starts when the leading edge of the sheet P reaches the contact portion (transfer portion) between the photosensitive drum 1 and the transfer roller 8. In this embodiment, a transfer roller is employed as the transfer means, however, a corona charger may be used in place thereof. The transfer sheet P having passed through the transfer portion, is separated from the photosensitive drum 1 surface, and is guided by the guiding plate 14 to the fixing roller couple 15*a* and 15*b*. Of the rollers 15*a* and 15*b*, the roller 15*a* is adapted to being contacted to such a side of the transfer sheet as bears the transferred image and is provided with a halogen heater to constitute a heating roller, whereas the roller 15*b* is adapted to contact the back side of the sheet material and is made of an elastic material to constitute a pressing roller. The sheet material now having the transferred image is fixed while being passed through the nip between the rollers 15*a* and 15*b*, by which the toner image is fixed on the surface of the sheet material by heat and pressure into a permanent image. The sheet is then discharged onto the tray 43 by the discharging roller 16 as a print.

The surface of the photosensitive drum 1 after the toner image is transferred is subjected to the cleaning operation by the cleaning device 4 having the cleaning blade 4*a*, so that the residual toner or other contaminations are wiped out to be prepared for the next image forming operation.

Referring to FIGS. 2–7, the description will be made as to the driving mechanism for transmitting driving force from the main assembly to the process cartridge in FIG. 1.

Figure 2:
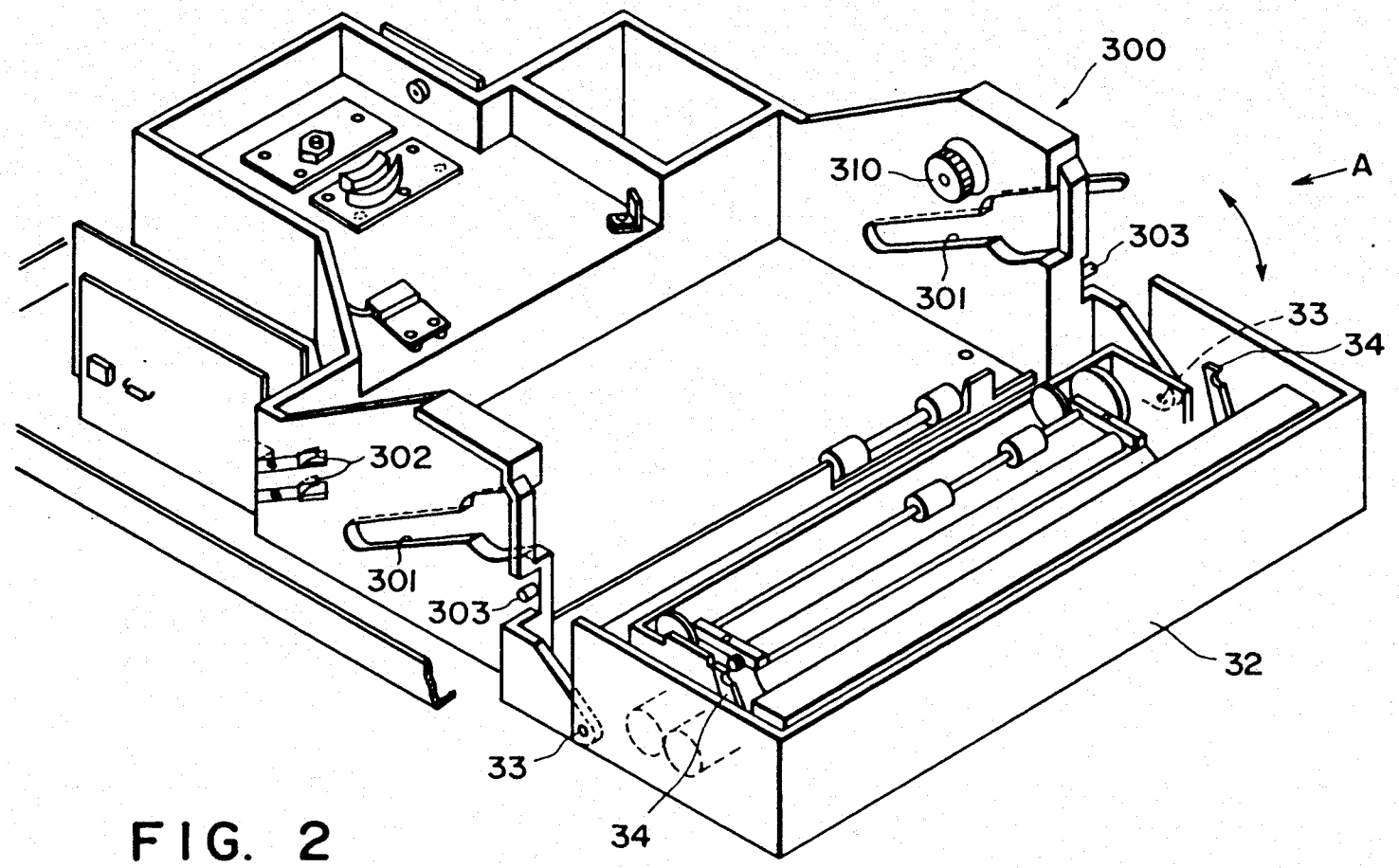
FIG. 2 is a perspective view of the apparatus of FIG. 1 illustrating mounting and dismounting of the process cartridge.

As shown in FIG. 2, opposite sides of the frame 300 in the outer casing 30 of the printer are provided with guiding grooves 301 and 301 formed therein to guide the process cartridge 100 during mounting and dismounting thereof. On one side of the frame 300, there is mounted a driving gear 310 for driving the photosensitive drum 1 in the process cartridge 100. Also, to the frame 300, the front door (outer cover) 32 is mounted which is rotatable about an axes of the shafts 33 and 33 in the directions of arrow A. FIG. 2 shows the state wherein the outer cover is opened. With this state, the process cartridge 100 is mounted into and dismounted from the frame 300 (supporting means) in the direction which is substantially perpendicular to the direction of the length of the photosensitive drum. Hooks 34 and 34 of the outer cover 32 are effective to lock the outer cover 32 by engagement with pins 303 and 303 of the frame 300.

Figure 3:
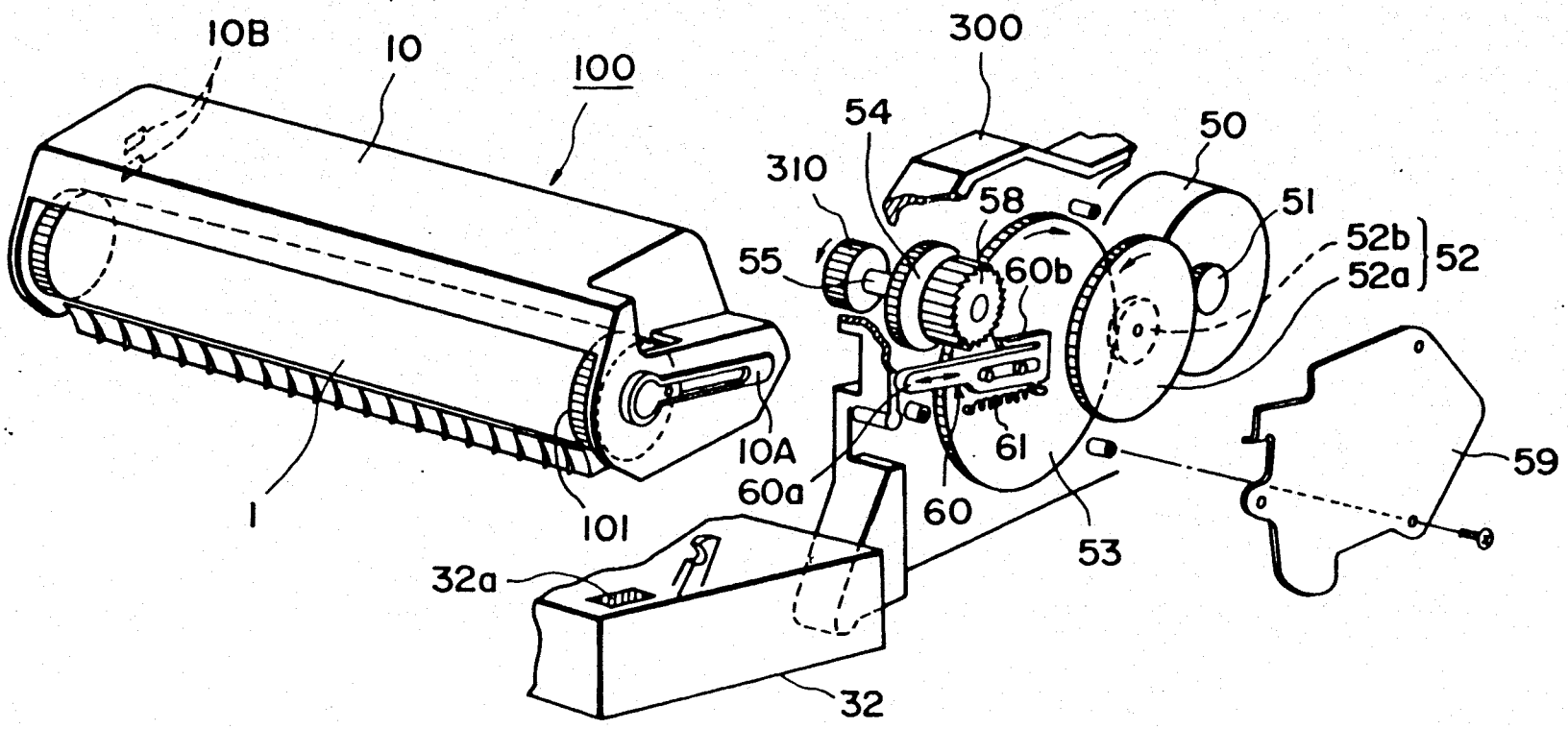
FIG. 3 is a perspective view of a drive transmission mechanism seen in a direction A of FIG. 2.

The opposite sides of the cartridge housing 10 of the process cartridge 100 are provided, as shown in FIG. 3, with projections 10A and 10A (only one of them is shown in the Figure) on the frame 300 for positioning engagement with the guiding grooves 301 and 301. A longitudinal end of the photosensitive drum 1 which is accommodated in the process cartridge 100 is provided with a drum gear 101, a driven gear, mounted thereto.

In this Figure, a protection cover 5 is omitted. The drum gear 101 is for meshing engagement with a driving gear 310 mounted on the frame 300 to receive driving force from the main assembly to drive the photosensitive drum 1. In this embodiment, the drum gear 101 is meshed not only with the photosensitive drum 1 gear but also with an unshown gear or gears for driving a developing sleeve 3*a* (FIG. 1) of the developing device 3 and a stirring member in the developing device. In FIG. 3, electric contacts 10B are provided on the process cartridge 100 so as to be in contact with contacts 302 of the frame 300 when the process cartridges mounted in the frame 300, to supply electric power to the process cartridge from the main assembly. By this, various means in the process cartridge can be supplied with electric power.

Figure 4:
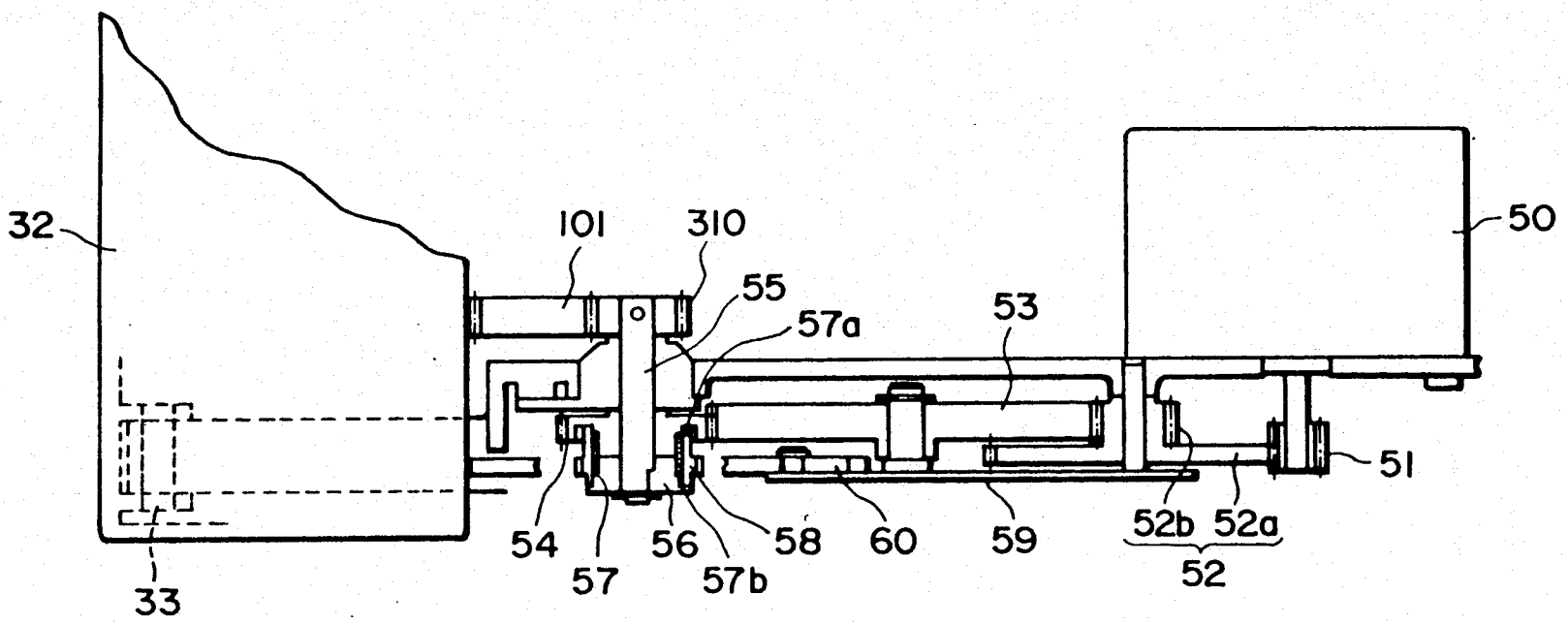
FIG. 4 is a sectional view of the drive transmission mechanism.

As shown in FIG. 3, the main assembly is provided with a driving motor 50 which has an output shaft provided with a small diameter motor gear 51. The motor gear 51 is in meshing engagement with a large diameter gear 52*a* of a reduction gear train 52 containing small and large gears 52*a* and 52*b*. The small gear 52*b* of the reduction gear train 52 is meshed with a large diameter idler gear 53, which is in turn meshed with a clutch gear 54. The clutch gear 54 is slidably supported on a driving shaft 55 having an outer end provided with a clutch boss 56 contacted to the clutch gear (FIG. 4). To the inside end of the driving shaft 55, the driving gear 310 is mounted. Further, as shown in FIG. 4, around the clutch gear 54 and the clutch boss 56, a control ring 58 is rotatably and loosely telescoped through a clutch spring 57. An end 57*a* of the clutch spring 57 is fixed to the control ring 58, and the other end 57*b* is fixed to the clutch boss 56. When the clutch spring 57 receives the rotational driving force from the driving motor 50, it becomes tightened. The reduction gear train 52 and the idler gear 53 are supported on the supporting plate 59, and a releasing lever 60 is mounted at the inside of the supporting plate 59 with an elongated slot for sliding movement in the direction indicated by an arrow, as shown in FIG. 3. The releasing lever 60 has an end portion 60*a* which is engaged to an abutment 32*a* of the outer cover 32 when the outer cover 32 is closed, and has a pawl 60*b* for selective engagement with the control ring 58. The releasing lever 60 is normally urged by a return spring 61 in the direction of the dismounting of the process cartridge 100.

When the outer cover 32 is opened, the pole 60*b* of the releasing lever 60 is engaged with the control ring 58 by the return spring 61.

Figure 5:
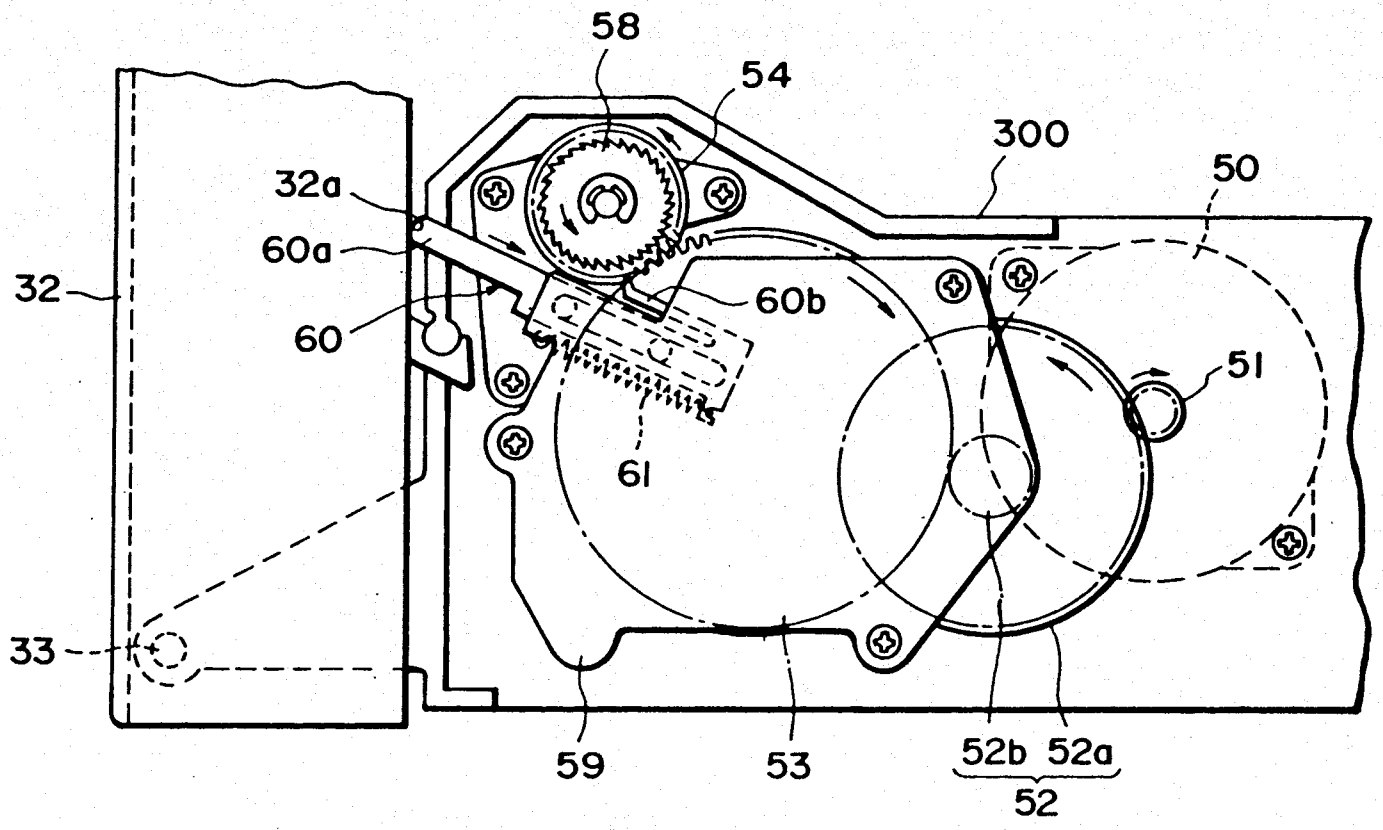
FIGS. 5 and 6 illustrate operation of a releasing lever.
Figure 7:
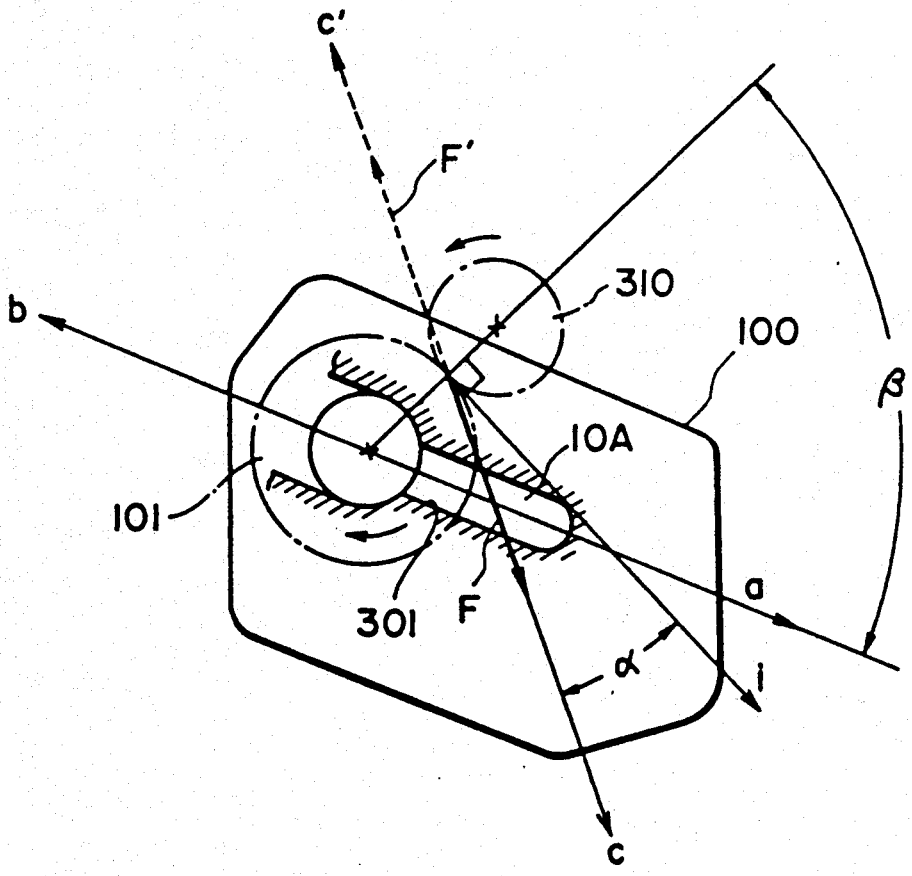
FIG. 7 illustrates force application to a drum gear when the process cartridge is mounted.

When the outer cover 32 is opened by rotation about the axes of the shafts 33 and 33 as shown in FIG. 2, and when the positioning projections 10A and 10A projected from the opposite sides of the process cartridge 100 are engaged with the guiding slots 301 and 301 of the frame 300, and in addition when the process cartridge is pushed in the direction a (cartridge mounting direction) shown in FIG. 7, the process cartridge 100 is mounted and placed at a predetermined position of the main assembly. At this time, the drum gear 101 of the process cartridge 100 is brought into engagement with the driving gear 310 of the main assembly. Thereafter, the outer cover 32 is rotated about the shafts 33 and 33 to close it as shown in FIGS. 4 and 5, by which the abutment 32*a* of the outer cover 32 is engaged to the end portion 60*a* of the releasing lever 60 so that the releasing lever 60 is moved in the direction indicated by an arrow in FIG. 5 against the spring force of the return spring 61. By this, the engagement between the pawl 60*b* of the releasing lever 60 and the control ring 58 is released.

In this state, the driving motor 50 of the main assembly is driven. The rotational force of the driving motor 50 is transmitted through the motor gear 51, the reduction gear train 52, the idler gear 53 and the clutch gear 54 to the clutch spring 57. At this time, the clutch spring 57 is tightened, as described hereinbefore, to transmit the rotational force to the clutch boss 56, by which the driving shaft 55 having the clutch boss 56 fixedly mounted thereto is rotated. The rotation of the driving shaft 55 is transmitted to the drum gear 101 of the process cartridge 100 through the driving gear 310, so that the photosensitive drum 1 and other necessary means in the process cartridge 100 are rotated to perform the required image forming operation. The direction of the force F (the direction of arrow c in FIG. 7) applied to the tooth surface of the drum gear 101 is deviated from a line 1 perpendicular to a line connecting the center of the drum gear 101 and the driving gear 310, by a pressure angle $\alpha$ of the gear, as shown in FIG. 7. The direction c is such that the process cartridge 100 is urged in this mounting direction (the direction a in FIG. 7) to stabilize the mounting position at least during the image forming operation in which the driving motor 50 is energized. As shown in FIG. 7, an angle $\beta$ formed between the position of the driving gear 310 and the process cartridge mounting direction, as seen from the central axis of the drum gear 101 satisfies, $\alpha<\beta<90$ degrees. The pressure angle $\alpha$ in this embodiment is 20 degrees.

Figure 6:
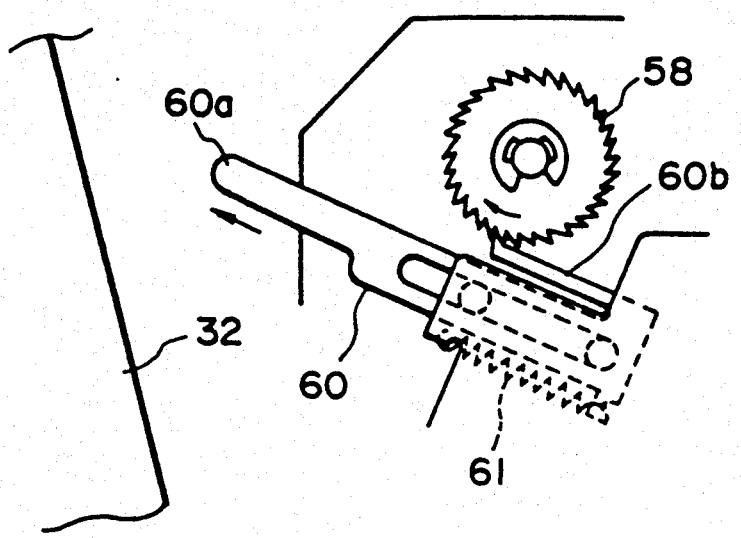

On the other hand, when the process cartridge 100 is removed from the main assembly, the outer cover 32 is opened, as shown in FIG. 6, and the process cartridge 100 is pulled in the direction of an arrow b, that is, the cartridge dismounting direction, in FIG. 7. When the outer cover 32 is opened for this purpose, the engagement between the end portion 60*a* of the releasing lever 60 and the abutment 32*a* of the outer cover 32 is released, and therefore, the releasing lever 60 is moved in the direction indicated by an arrow in FIG. 6 by the spring force provided by the return spring 61. By the movement of the releasing lever 60, the pawl 60*b* of the releasing lever 60 rotates the control ring 58 through a predetermined angle in a direction (the direction indicated by an arrow in FIG. 6) opposite to the direction for the image formation. Therefore, the clutch spring 57 is imparted with a loosening force, by which the driving gear 310 is rotated in the opposite direction.

As described in the foregoing, when the outer cover 32 is opened and when the process cartridge 100 is dismounted, the driving gear 310 is rotated in the opposite direction, so that the gear surface of the drum gear 101 meshed with the driving gear 310 is imparted with force F′ in the direction (broken line direction c′ in FIG. 7) which is the opposite to that during the driving operation. Since the force F′ is such that the process cartridge is urged in a dismounting direction (the direction b in FIG. 7), the process cartridge 100 can be easily taken out of the main assembly. This effect is particularly remarkable when the process cartridge rotating load and/or the reverse load of the driving gear 310 are heavy.

As will be understood from the foregoing, the drum gear 101 for driving the photosensitive drum 1 in the process cartridge 100 receives the force in the direction of pushing it for this mounting thereof when the outer cover 32 is opened if the cartridge 100 is placed in the main assembly. On the other hand, when the outer cover 32 is closed, it receives the force in the direction of pushing the process cartridge 100 to be positively mounted in the main assembly.

Figure 8:
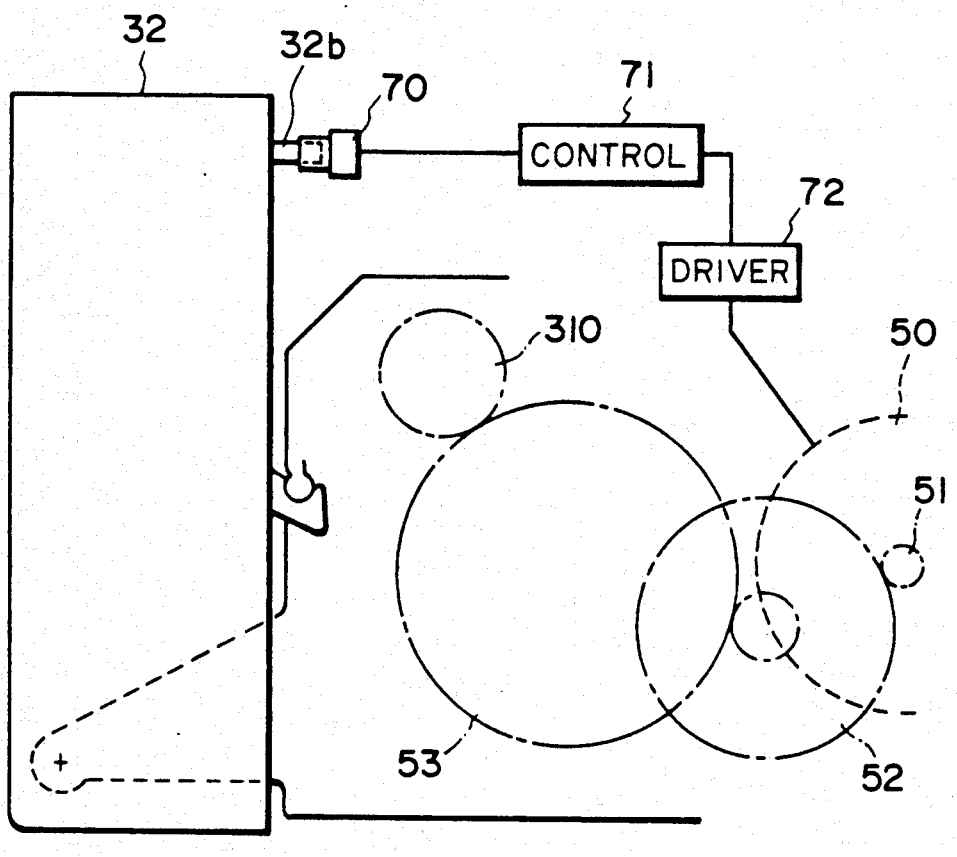
FIG. 8 is a schematical view of an image forming apparatus according to another embodiment of the present invention.

Referring to FIG. 8, another embodiment of the present invention will be described, which is different from the foregoing embodiment particularly in the mechanism for dismounting the process cartridge. The drive transmission mechanism in this embodiment is similar to that shown in FIG. 5, and the same reference numerals as in FIG. 5 are assigned to the elements having the same function.

The mechanism of this embodiment is not provided with the clutch gear 54, the clutch boss 56, the clutch spring 57 and the control ring 58 of the foregoing embodiment. Instead, the driving gear 310 is directly meshed with the idler gear 53. The outer cover 32 is provided with a projection 32*b*. When the outer gear 32 is closed, as shown in this Figure, the projection 32*b* is engaged with a detection sensor 70, so that the detection sensor 70 is rendered on.

When the outer cover 32 is opened for the purpose of dismounting the process cartridge 100 from the main assembly, the projection 32*b* of the outer cover 32 is removed from the detecting sensor 70, so that the detecting sensor 70 is rendered off. By the switching of the detecting sensor 70 from the on state to the off state, the resultant signal of the detecting sensor 70 is supplied to the control device 71, which in turn transmits a control signal to the motor driver circuit 72, by which the motor driver drives the driving motor 50 for a predetermined period of time in the reverse direction. As a result, similarly to the foregoing embodiment, the driving gear 310 is reversely rotated in association with the opening of the outer cover 32. Therefore, the process cartridge 100 can be easily taken out of the main assembly without difficulty, similarly to the foregoing embodiment.

Figure 9:
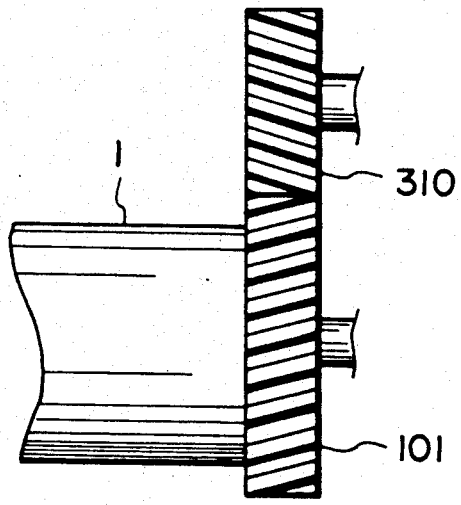
FIG. 9 illustrates gears used in an image forming apparatus according to a further embodiment of the present invention.

In the foregoing embodiments, each of the drum gear and the driving gear is in the form of a spur gear, but may be in the form of a helical gear as shown in FIG. 9 and as disclosed in U.S. Ser. No. 66,658 filed on June 23, 1987, now U.S. Pat. No. 4,829,335 and assigned to the assignee of the present application. When the helical gear is used, the process cartridge can be more stably situated at the predetermined position during the drive of the photosensitive drum. In addition, in the foregoing embodiments, a drum gear is employed as a member to be driven in the process cartridge, but this is not limiting. If, for example, a driven member (for example, a gear for the developing roller) in the process cartridge other than the drum gear is meshed with a driving member in the main assembly to directly transmit the driving force from the driving member to the driven member, the structure of the present invention is applicable with the advantage to the meshing engagement portion.

The mechanism for controlling the rotation of the driving gear in the main assembly is not limited to that disclosed in the embodiment.

As described in the foregoing, according to the present invention, when the cover is opened, and the process cartridge is to be dismounted from the main assembly of the image forming apparatus, the driven member of the process cartridge receives, in response to the cover opening operation, the force having a component in the direction of the cartridge dismounting. As a result, the process cartridge can be easily dismounted from the main assembly. On the other hand, when the apparatus is operated, the driven member of the process cartridge receives the force having a component of the process cartridge mounting, and therefore, the position of the process cartridge relative to the main assembly is stabilized.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

means for detachably supporting a process cartridge, said process cartridge containing a movable image bearing member, at least one process means for forming an image on the image bearing member and driven means for receiving a driving force from said image forming apparatus;

driving means engageable with the driven means of the process cartridge to drive the driven means;

an openable and closable member forming a part of a casing of said image forming apparatus; and applying means for applying to said driving means a force for urging the process cartridge in response to opening said openable and closable member.

2. An apparatus according to claim 1, wherein the driven means drives the image bearing member of the process cartridge.

3. An apparatus according to claim 1 or 2, wherein the driven means includes a gear, and said driving means includes a gear.

4. An apparatus according to claim 3, wherein said applying means applies force to said driving means, in response to opening of said openable and closable member, to rotate the gear of said driving means in a direction opposite to a direction of its rotation during image forming operation.

5. An apparatus according to claim 4, wherein the gear of said driving means is mounted on said supporting means.

6. An apparatus according to claim 3, wherein during an image forming operation the gear of said driving means is engaged with the gear of said driven means and the process cartridge is urged in a direction for mounting the process cartridge of said supporting means.

7. An apparatus according to claim 3, wherein the driven gear and the driving gear are helical gears.

8. An apparatus according to claim 1 or 2, wherein said process cartridge is detachably mountable relative to said supporting means when said openable and closable member is opened.

9. An apparatus according to claim 1, wherein said openable and closable member is openable and closable relative to said supporting means.

10. An apparatus according to claim 1, said applying means includes clutch means for controlling operation of said driving means.

11. An apparatus according to claim 1 or 2, wherein the process cartridge is detachably mountable relative to said supporting means in a direction substantially perpendicular to a longitudinal direction of the image bearing member.

12. An apparatus according to claim 11, wherein said process cartridge includes a positioning portion, and said supporting means includes a guiding portion for guiding the positioning portion, and wherein said process cartridge is situated at a predetermined position of said image forming apparatus by inserting said process cartridge along the guiding portion of said supporting means.

13. An image forming apparatus, comprising:

means for detachably supporting a process cartridge which contains a movable image bearing member, at least one process means for forming an image on the image bearing member and driven means for receiving a driving force from said image forming apparatus;

driving means engageable with the driven means of the process cartridge to drive the driven means, said driving means and said driven means each including a gear;

an openable and closable member; and applying means for applying to said driving means in response to an opening of said openable and closable member a force to urge the process cartridge to disengage from said supporting means, wherein a pressure angle $\alpha$ of the gears, an angle $\beta$ formed between a line connecting the centers of the gears and a direction of mounting the process cartridge, satisfy $$\alpha < \beta < 90 \text{ degrees.}$$

14. An apparatus according to claim 13, wherein the driving means is provided in said supporting means.

15. An apparatus according to claim 13, wherein said driven means drives the image bearing member of the process cartridge.

16. An apparatus according to claim 13, wherein the process cartridge is detachably mountable relative to said supporting means in a direction substantially perpendicular to a longitudinal direction of the image bearing member.

17. An image forming apparatus comprising:

means for detachably supporting a process cartridge, said process cartridge containing a movable image bearing member;

at least one process means for forming an image on the image bearing member and a driven means of said process cartridge for receiving a driving force from said image forming apparatus;

driving means engageable with the driven means of the process cartridge to drive the driven means;

an openable and closeable member constituting a part of a casing of said image forming apparatus; and applying means for applying to said driving means a force for urging the process cartridge in a direction for dismounting and mounting the process cartridge within the image forming apparatus in response to opening and closing, respectively, said openable and closeable member.

18. An apparatus according to claim 17, wherein said process cartridge is mountable to or dismountable from said supporting means when said openable and closable member is opened.

19. An apparatus according to claim 17, wherein the force for urging said process cartridge is imparted to the process cartridge at least during image forming operation.

20. An apparatus according to claim 17, wherein said driven means drives the image bearing member of the process cartridge.

21. An apparatus according to claim 20 or 17, wherein the process cartridge is detachably mountable relative to said supporting means in a direction substantially perpendicular to a longitudinal direction of the image bearing member.

22. An apparatus according to claim 1, 13 or 17, wherein the process cartridge includes as the process means, at least one of charging means, developing means and cleaning means.

23. An apparatus according to claim 1, 13 or 17, wherein said openable and closable member is opened and closed at a sheet conveying passage.

24. An apparatus according to claim 23, wherein said openable and closable member supports means, of said process cartridge, for transferring an image formed on said image bearing member onto a sheet and means for fixing the transferred image on the sheet.

25. An apparatus according to claim 1, 13 or 17, further comprising a laser beam scanner.

* * * * *

UNITED STATES PATENT AND TRADEMARK OFFICE

CERTIFICATE OF CORRECTION

PATENT NO. : 5,047,803

DATED : September 10, 1991

INVENTOR(S) : Masanobu Kanoto

It is certified that error appears in the above-identified patent and that said Letters Patent is hereby corrected as shown below:

COLUMN 5:

Line 13, "mounted" should read --are mounted--.

COLUMN 6:

Line 20, "line 1" should read --line i--.
Line 68, "this mounting" should read --dismounting--.

COLUMN 7:

Line 19, "outer gear 32" should read --outer cover 32--.

COLUMN 8:

Line 47, "of" should read --to--.
Line 57, "claim 1, said" should read --claim 1, wherein said--.

UNITED STATES PATENT AND TRADEMARK OFFICE

CERTIFICATE OF CORRECTION

PATENT NO. : 5,047,803 Page 2 of 2

DATED : September 10, 1991

INVENTOR(S) : Masanobu Kanoto

It is certified that error appears in the above-identified patent and that said Letters Patent is hereby corrected as shown below:

COLUMN 10:

Line 5, "closeable" should read --closable--.
Line 12, "closeable" should read --closable--.

Signed and Sealed this

Eighteenth Day of May, 1993

*Attest:*

Michael K. Kirk

MICHAEL K. KIRK

*Attesting Officer*

*Acting Commissioner of Patents and Trademarks*